US005890431A

United States Patent [19]

Schäfer

[11] Patent Number: 5,890,431

[45] Date of Patent: Apr. 6, 1999

[54] INK SUPPLY DEVICE

[75] Inventor: Karl Robert Schäfer, Rimpar, Germany

[73] Assignee: Koenig & Bauer-Albert Aktiengesellschaft, Wurzburg, Germany

[21] Appl. No.: 928,494

[22] Filed: Sep. 12, 1997

[30] Foreign Application Priority Data

Sep. 12, 1996 [DE] Germany ..... 196 36 985.1

[51] Int. Cl.[6] ..... B41F 31/00

[52] U.S. Cl. ..... 101/335; 101/366

[58] Field of Search ..... 101/335, 336, 101/DIG. 34, DIG. 45, 364, 363, 210, 208

[56] References Cited

U.S. PATENT DOCUMENTS

| | | | |
|---|---|---|---|
| 3,738,265 | 6/1973 | Saueressig | 101/157 |
| 3,804,012 | 4/1974 | Bosshardt | 101/122 |
| 3,987,727 | 10/1976 | Thatcher | 101/366 |
| 5,150,651 | 9/1992 | Flores | 101/207 |
| 5,224,424 | 7/1993 | Layland | 101/425 |
| 5,343,805 | 9/1994 | Lovenbrant et al. | 101/DIG. 34 |
| 5,511,889 | 4/1996 | Tokar | 400/197 |
| 5,520,106 | 5/1996 | Karlyn et al. | 101/126 |

FOREIGN PATENT DOCUMENTS

| | | |
|---|---|---|
| 393939 | 10/1990 | European Pat. Off. . |
| 716923 | 6/1996 | European Pat. Off. . |
| 1546670 | 11/1968 | France . |
| 870 816 | 3/1953 | Germany . |
| 1950236 | 11/1966 | Germany . |
| 2625850 | 12/1976 | Germany . |
| 31 28 887 | 10/1985 | Germany . |
| 4310282 | 10/1994 | Germany . |
| 296 02 801 | 8/1996 | Germany . |
| 3288366 | 10/1995 | United Kingdom . |

*Primary Examiner*—Edgar Burr
*Assistant Examiner*—Anthony H. Nguyen
*Attorney, Agent, or Firm*—Jones, Tullar & Cooper, P.C.

[57] ABSTRACT

Ink is supplied to an ink duct in a rotary printing press from an ink cartridge. The cartridge receives a piston which can be pushed into the cartridge from one end to force ink out of the discharge end of the cartridge. This piston is moved through the cartridge by a helical gear in the form of a rotatable spindle driven by an electric motor.

8 Claims, 2 Drawing Sheets

INK SUPPLY DEVICE

FIELD OF THE INVENTION

The present invention is directed generally to an ink supply device. More particularly, the present invention is directed to a device for supplying ink to an inking system. Most specifically, the present invention is directed to an ink supply device for supplying ink to an inking system of a rotary printing press. The ink is stored in an ink cartridge which is positionable on a cross arm. This cross arm is pivotably supported by a side frame of the rotary printing press. A piston is engageable with a first end of the ink cartridge and can be advanced into the cartridge by a helical gear to force ink out of the cartridge. The position of the piston in the cartridge and its rate of travel through the cartridge can be regulated as a function of ink volume delivery, ink level in an ink reservoir, or ink usage per unit of time.

DESCRIPTION OF THE PRIOR ART

In the field of rotary printing there are many different systems which are utilized to supply printing ink to the printing plate or plates. One such system uses an ink reservoir and a so-called screen surface or alnico roller to provide ink to the surface of the printing plate or plates. The ink that is used in such an inking system may be supplied to the ink chamber or ink reservoir in a variety of ways. These range from the simple expedient of manually filling the ink reservoir from a supply container to various sophisticated pump systems.

One prior art ink supply arrangement is depicted in German patent document DE 296 02 801 U1. In this prior art process, the printing ink is squeezed out of an ink supply cartridge by a piston. The piston is actuated by compressed air.

Another prior art ink supply configuration is shown in German patent document DE-PS 870 816. This document depicts a manual ink press that is used to squeeze ink out of a tube. A piston is utilized to squeeze the ink containing tube and this piston is actuated by a threaded spindle.

In such prior art devices, there has been an inability to accurately control the dispensing of the ink either on a volume basis or as a function of time. It has not been easy to control the position of the piston in air actuated systems. Manual systems require the intervention of an operator to manually turn a threaded spindle to force ink out of a tube. The attention of the operator is apt to be diverted to other tasks with the end result being that insufficient ink may be dispensed.

It will be seen that a need exists for an arrangement to provide ink which overcomes the limitations of the prior art. The ink supply device in accordance with the present invention provides such a device and is a significant improvement over the prior art devices.

SUMMARY OF THE INVENTION

It is an object of the present invention to provide an ink supply device.

Another object of the present invention is to provide an ink supply device for an inking system.

A further object of the present invention is to provide an ink supply device for an inking system of a rotary printing press.

Still another object of the present invention is to provide an ink supply device in which a piston is used to squeeze ink out of an ink containing cartridge.

Yet a further object of the present invention is to provide an ink supply device in which a piston for squeezing ink from a cartridge is actuated by a helical gear that is driven by an electric motor.

Even still another object of the present invention is to provide an ink supply device in which an ink containing cartridge is supported on a cross arm which is, in turn supported for movement with respect to side arms of a rotary printing press.

As will be discussed in detail in the description of the preferred embodiment which is presented subsequently, the device for supplying ink to an ink reservoir in a rotary printing press utilizes an ink containing cartridge that is supported by a cross arm adjacent an ink receiving reservoir. The ink cartridge is shaped to receive a movable piston which is caused to be moved by a helical gear, such as a lead screw or threaded spindle that is, in turn, driven by an electric motor. As the piston is moved into the ink cartridge, the ink in the cartridge will be forced out through a suitable ink outlet and into an ink duct, such as an ink receiving reservoir. The amount of ink supplied to the ink duct can be controlled by the provision of a sensor that will provide information on the rotational speed or the position of the threaded spindle. Alternatively, a suitable level sensor can be situated in the ink duct and can actuate the electric drive motor for the helical gear when the ink level in the ink duct falls below the sensor.

The device for supplying ink in accordance with the present invention allows the quantity of ink being supplied from the cartridge to be precisely metered. The use of the electric motor, in conjunction with a helical gear, such as a lead screw or a threaded spindle, will facilitate the accurate, positional control of the piston in the ink cartridge. Whether the ink is dispensed as a function of usage over a certain amount of time, as a function of the ink level in the ink duct, or at a constant rate, the ink supply device of the present invention insures a consistent, controlled ink delivery.

The spindle actuating motor assembly of the ink supply device of the present invention is an uncomplicated device which facilitates the precise metering of the ink from the ink cartridge. A position sensor can be utilized with the threaded spindle of the spindle actuating motor assembly. This sensor can be an angular momentum transducer which will insure that the location and rotational speed of the spindle is accurately known at all times.

The ink supply device of the present invention positions the ink cartridge and the threaded spindle actuating motor assembly on a cross arm. This cross arm is pivotably attached to one of the side frames of the press so that it can be easily moved out of the way. The ink supply roller and the ink duct can thus be easily accessed once the cross arm has been pivoted out of the way.

The ink supply device in accordance with the present invention overcomes the limitations of the prior art devices. It is a substantial advance in the art.

BRIEF DESCRIPTION OF THE DRAWINGS

While the novel features of the ink supply device in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
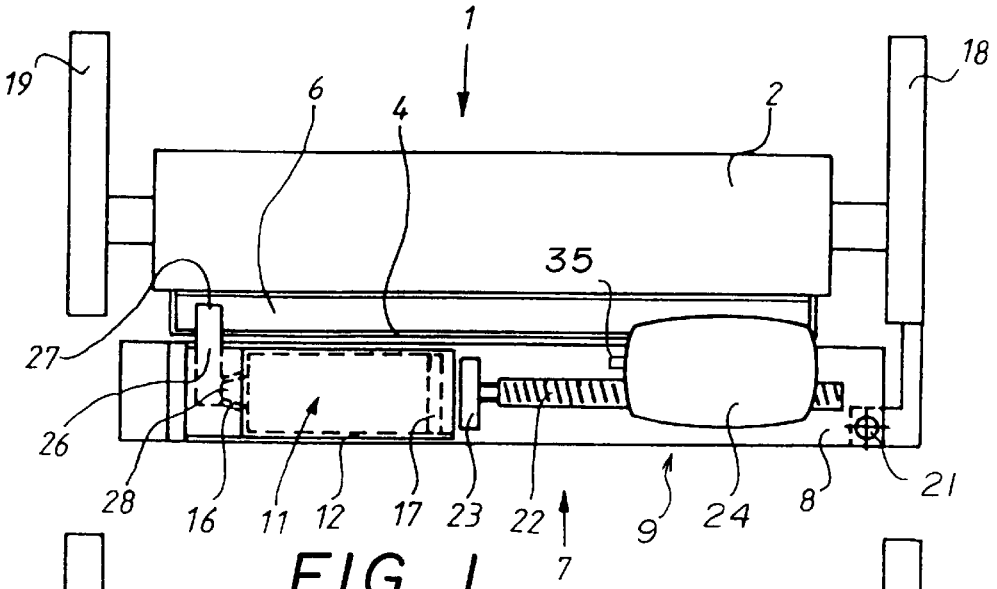
FIG. 1 is a schematic top plan view, with portions removed for clarity, of a device for supplying ink in accordance with the present invention, and showing the device in a working position.

Referring initially to FIG. 1, there may be seen generally at 1 an ink metering device that is usable to supply ink to an inking system of a rotary printing press. The ink metering device 1 utilizes an ink roller, such as a screened surface or anilox roller 2, to transfer ink from an ink duct 4 that is provided with an ink doctor blade or doctor device 3, as may also be seen in FIGS. 2 and 3. The screen roller 2 is typically in contact with another roller, a plate cylinder, or the like which is not shown in the drawings. Such an ink metering device 1 is generally known in the art and will not be discussed in detail.

Figure 2:
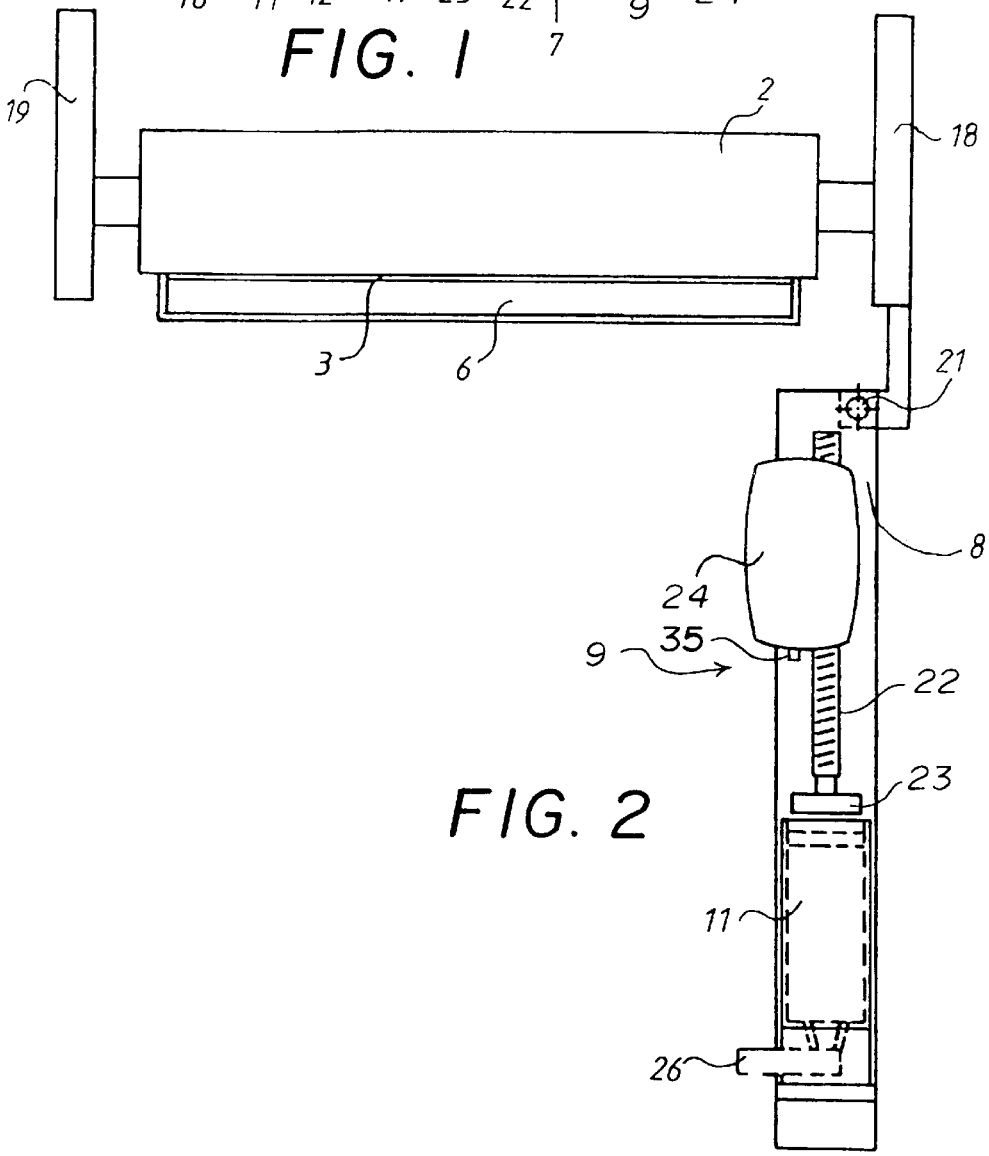
FIG. 2 is a view similar to FIG. 1 and showing the device in its maintenance position.
Figure 3:
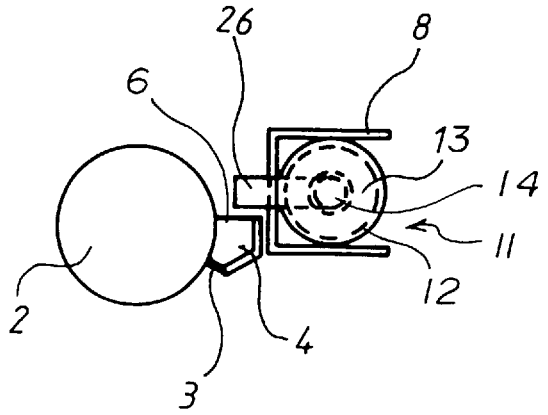
FIG. 3 is a schematic end view of the ink supply device in accordance with the present invention.

As may be seen most clearly in FIGS. 2 and 3, the ink receiving duct 4 or ink reservoir is typically an open duct that has an opening 6 which facilitates the supply of ink to the duct 4. This opening 6 may be an open upper face of the ink duct 4, or could be an opening in an otherwise closed upper face of duct 4. An ink supply device, generally at 7, in accordance with the present invention, supplies printing ink to the ink supply duct 4 through its opening 6. As may be seen most clearly in FIGS. 1 and 2, the ink supply device 7 includes a pivotable cross arm 8, a helical gear, which is included in a spindle actuating motor assembly, generally at 9, and a receptacle or holder for a replaceable ink cartridge 11.

As is depicted in FIGS. 1–3, the ink cartridge 11 has a generally cylindrical sleeve or tube 12 as its body. Sleeve 12 is closed at a first or discharge end by a cover 13. This cover 13 is provided with an outlet opening 14 which can, for example, be integrated into a central fastening thread or nipple 16 that is situated centrally in the discharge end face cover 13 of the ink cartridge 11. A second or disk end of the sleeve or tube 12 is closed by a disk 17 that will function as a piston. This disk 17 can be slid along the internal length of sleeve 12. The sleeve 12, discharge end face cover 13 and disk 17 comprise a reservoir for the ink that is to be dispensed from the cartridge 11 into the ink duct 4.

The ink cartridge 11 and the helical gear in the form of the spindle actuating motor assembly 9 are supported on a pivotable cross arm, generally at 8, as may be seen most clearly in FIGS. 1 and 2. Cross arm 8 is disposed, in its working position depicted in FIG. 1, generally parallel to an axis of rotation of the screen roller 2 and is supported between spaced side frames 18 and 19 of the rotary printing press. A suitable pivot joint 21 connects one end of the cross arm 8 to the side frame or support 18. This will allow the cross arm 8 to pivot in a horizontal plane parallel to the supply opening 6 of the ink duct 4, as seen in FIGS. 2 and 3. The cross bar 8 could also be supported by a suitable pivot joint so that it could pivot in a generally vertical direction with respect to the ink duct 4. The pivot direction of the cross arm 8 would be chosen taking into consideration the structure of the surrounding press elements so that the exposure of the ink duct 4 and of the screen roller 2 would be maximized when the cross arm 8 is pivoted out of its work position, depicted in FIG. 1, to its maintenance position depicted in FIG. 2. The cross arm 8 may be generally U-shaped in cross-section, as depicted in FIG. 3. It will be understood that the upper leg of the cross-arm 8 has been removed in FIGS. 1 and 2 for clarity of illustration.

The helical gear or spindle actuating motor assembly, generally at 9, is supported on the cross arm 8 generally at a first end of the cross arm 8 adjacent the pivot joint 21. A threaded spindle 22 extends from an electric motor 24 so that the axis of rotation of the threaded spindle or lead screw 22 is generally parallel to the axis of rotation of the screen roller 2. A spindle piston 23 is disposed at a free end of the spindle 22, which passes through the electric motor 24. This spindle piston 23 has a diameter that is sized to be received in the inner surface of sleeve 12 of the ink cartridge 11. The spindle piston head 24 can engage the disk 17 that closes the disk end of sleeve 12. Alternatively, the end of sleeve 12 adjacent the spindle piston 23 could be closed with only a layer of foil or the like, and spindle piston 23 could be sized to form a sliding seal with the inner wall surface of the ink cartridge sleeve 12.

The threaded spindle 22 is caused to move along its longitudinal direction by means of a nut that is not specifically shown. This nut is rotatable by the electric motor 24 but is otherwise stationary with respect to the cross arm 8. The nut, threaded spindle 22 and electric motor 24 essentially comprise the spindle actuating motor assembly 9.

The electric motor 24 or the threaded spindle 22 can be provided with a suitable sensor 35 which will be used to determine the position of the spindle 22. In the preferred embodiment of the ink supply device in accordance with the present invention, the electric motor 24 can be, for example, provided with an angular momentum transducer as sensor 35. The electric motor 24 is advantageously provided as a stepping motor.

The ink cartridge 11 is receivable on, and is held on the cross arm 8 so that the disk end of sleeve 12 will be adjacent to, and properly aligned with the spindle piston 23. A suitable stop wall can be provided in the cross arm 8 more adjacent its free end. This stop wall can be provided with a central, threaded aperture into which the externally threaded nipple 16 at the discharge end of replaceable cartridge 11 can be positioned. In the preferred embodiment of the ink supply device of the present invention, a tubular discharge outlet 26 can be attached to the cross arm 8 and will receive the discharge end of ink cartridge 11. This tubular discharge outlet 26 extends generally perpendicularly to the longitudinal direction of the cross arm 8 and generally toward the ink supply opening 6 of the ink duct 4. The tubular outlet 26 has an ink discharge opening 27 on its end that is situated over the ink duct 4. On its end which overlies the cross arm 8, the tubular discharge outlet 26 is provided with a threaded bore 28 that will receive the discharge end of the replaceable ink cartridge 11 and specifically can receive the nipple 16 that is situated centrally in the discharge end face cover 13 of the ink cartridge 11.

The ink supply device in accordance with the present invention operates in the following manner. In order to supply ink from the ink cartridge 11 to the ink duct 4, the electric motor 24 of the spindle actuating motor assembly 9 is turned on. This causes the spindle 22 to rotate and to extend so that the spindle piston 23 will move toward the disk end of the ink cartridge. It will be understood that motor 24 is a reversible motor which will also facilitate the withdrawal of the spindle piston 23 from the sleeve 12 of the ink cartridge 11. The spindle piston 23 will contact the ink cartridge disk 17 and will move disk 17 to the left, as viewed in FIG. 1. This will cause printing ink that had been stored in the ink cartridge 11 to be forced out the nipple 16 of the cartridge, into the tubular discharge outlet 26 and through the ink discharge opening 27 into the ink duct 4.

As discussed above, the motor 24 is preferably a reversible stepping motor which can be controlled either manually or in a preset, metering fashion. Since the position of the threaded spindle 22 is known, the amount of spindle travel required to dispense a certain amount of ink can be readily arrived at and the motor can be caused to operate for a sufficient period of time to accomplish the dispensing of the desired amount of ink.

It is also possible, in accordance with the present invention, to carry out the regulation of the operation of the helical gear or spindle actuating motor assembly 9 through the provision of a fill level sensor in the ink duct 4. It would also be possible to control the operation of the spindle actuating motor assembly or helical gear 9 as a function of ink quantity per unit of time. Since the amount of printing ink used for each printing application as a function of time is known, the assembly 9 can be controlled by appropriate control of the speed of the motor 24 to insure that the desired quantity of ink, as a function of time, is forced out of the ink cartridge 11. The reversible stepping motor 24 of the spindle actuating motor assembly 9 of the present invention is particularly adaptable to accomplishing the automatic supply of ink. Since the volume of the ink cartridge 11 is known, as is the ink usage rate, the linear movement of the spindle piston 23 in the sleeve 12 can be controlled by controlling the rotational speed of spindle 22 through control of the speed of the motor 24.

While a preferred embodiment of an ink supply device in accordance with the present invention have been set forth fully and completely hereinabove, it will be apparent to one of skill in the art that a number of changes in, for example, the size of the screen roller, the type of ink being supplied, the type of drive for the screen roller and the like could be made without departing from the true spirit and scope of the present invention which is accordingly to be limited only by the following claims.

What is claimed is:

1. An ink supply device for supplying ink to an inking system of a rotary printing press comprising:

a replaceable ink cartridge having a supply of ink, said replaceable ink cartridge including first and second ends;

a cross arm adapted to support said replaceable ink cartridge adjacent to the inking system of a rotary printing press;

a piston adapted to be inserted into said first end of said replaceable ink cartridge to force ink out of said second end of said replaceable ink cartridge, said piston being supported on said cross arm;

a helical gear for moving said piston into and out of said first end of said replaceable ink cartridge to force ink out of said second end of said replaceable ink cartridge; and an electrical motor for driving said helical gear, said electric motor being supported on said cross arm.

2. The ink supply device of claim 1 wherein said helical gear is a rotatable threaded spindle.

3. The ink supply device of claim 2 wherein said piston is supported on said threaded spindle.

4. The ink supply device of claim 1 further including a slidable disk in said replacable ink cartridge, said piston engaging said disk.

5. The ink supply device of claim 1 further including a sensor for determining a position of said helical gear.

6. The ink supply device of claim 1 further including means for supporting said cross arm for movement with respect to the inking system of a rotary printing press.

7. The ink supply device of claim 6 wherein the printing press includes spaced side frames and further wherein said cross arm is supported between said side frames.

8. The ink supply device of claim 7 further including a pivot joint between said cross arm and one of said spaced frames.

* * * * *